US009972904B2

(12) United States Patent
Fang et al.

(10) Patent No.: US 9,972,904 B2
(45) Date of Patent: May 15, 2018

(54) ELECTRONICALLY TUNABLE ANTENNA BASED ON ORIENTATION CORRECTION AND ADJUSTMENT AND ELECTRONICALLY TUNABLE ANTENNA SYSTEM

(71) Applicant: TONGYU COMMUNICATION INC., Zhongshan (CN)

(72) Inventors: Zeming Fang, Zhongshan (CN); Jifa He, Zhongshan (CN); Guosheng Yu, Zhongshan (CN); Jiping Mao, Zhongshan (CN); Zhonglin Wu, Zhongshan (CN); Wenlan Wang, Zhongshan (CN)

(73) Assignee: TONGYU COMMUNICATION INC., Zhongshan (CN)

( * ) Notice: Subject to any disclaimer, the term of this patent is extended or adjusted under 35 U.S.C. 154(b) by 39 days.

(21) Appl. No.: 14/341,087

(22) Filed: Jul. 25, 2014

(65) Prior Publication Data

US 2014/0333499 A1 Nov. 13, 2014

Related U.S. Application Data

(63) Continuation of application No. PCT/CN2013/074361, filed on Apr. 18, 2013.

(30) Foreign Application Priority Data

Apr. 20, 2012 (CN) ..... 2012 1 0118443

(51) Int. Cl.
*H01Q 3/00* (2006.01)
*H01Q 1/12* (2006.01)
(Continued)

(52) U.S. Cl.
CPC ..... *H01Q 3/00* (2013.01); *H01Q 1/125* (2013.01); *H01Q 1/246* (2013.01); *H01Q 1/50* (2013.01);
(Continued)

(58) Field of Classification Search
CPC ..... H01Q 3/005; H01Q 3/08; H01Q 1/125
See application file for complete search history.

(56) References Cited

U.S. PATENT DOCUMENTS

2001/0033247 A1* 10/2001 Singer ..... H01Q 1/246 342/359
2005/0248498 A1* 11/2005 Webb ..... H01Q 1/08 343/880
(Continued)

FOREIGN PATENT DOCUMENTS

CN 201311966 9/2009
CN 201732859 2/2011
CN 102655269 9/2012

*Primary Examiner* — Daniel J Munoz
(74) *Attorney, Agent, or Firm* — Hamre, Schumann, Mueller, Larson, P.C.

(57) ABSTRACT

The present disclosure provides an electronically tunable antenna based on orientation correction and adjustment and an electronically tunable antenna system. The main body of the electronically tunable antenna includes at least one electronically tunable antenna body. The electronically tunable antenna includes: an attitude sensing device fixed to the electronically tunable antenna body, the electronically tunable antenna is used for sensing horizontal orientation angle, mechanical tilt angle, latitude, longitude and height in real time; and an antenna control unit connected to the attitude sensing device, the antenna control unit is used for adjusting electrical downtilt angle of the electronically tunable antenna body and transmits to outside the horizontal orientation angle, mechanical tilt angle, latitude, longitude and height information sensed by the attitude sensing device.

14 Claims, 3 Drawing Sheets

(51) Int. Cl.

| | |
|---|---|
| ***H01Q 1/24*** | (2006.01) |
| ***H01Q 1/50*** | (2006.01) |
| ***H01Q 3/08*** | (2006.01) |
| ***H01Q 23/00*** | (2006.01) |

(52) U.S. Cl.
CPC ..... *H01Q 3/005* (2013.01); *H01Q 3/08* (2013.01); *H01Q 23/00* (2013.01)

(56) References Cited

U.S. PATENT DOCUMENTS

2006/0244675 A1* 11/2006 Elliot ..... H01P 1/18
343/853
2007/0229378 A1* 10/2007 Clark ..... H01Q 1/125
343/757
2012/0218159 A1* 8/2012 Ke ..... H01Q 3/08
343/760

* cited by examiner

ELECTRONICALLY TUNABLE ANTENNA BASED ON ORIENTATION CORRECTION AND ADJUSTMENT AND ELECTRONICALLY TUNABLE ANTENNA SYSTEM

FIELD

The present disclosure relates to base station antenna used in wireless communication, and more particularly to an electronically tunable antenna based on orientation correction and adjustment and an electronically tunable antenna system.

BACKGROUND

The technology of mobile communication base station antenna is developing rapidly. At first, ordinary directional antennas and omni-directional antennas were mainly used domestically. Nowadays, electronically tunable antenna is more and more popular. The so-called electronically tunable antenna refers to base station antenna of which the electrical downtilt angle is adjustable. The principle of electrical downtilt is, by changing the phase of conformal linear array antenna element, to change the amplitude of vertical component and horizontal component of the field strength and change the field strength of synthetic component, thereby making the vertical directivity pattern of the antenna tilt downward. Since the field strength of the antenna in all directions simultaneously increase and decrease, it is guaranteed that the shape of the antenna directivity pattern basically remains unchanged after changing the tilt angle, thereby shortening the coverage distance of the main lobe direction and reducing the coverage area for the entire pattern in service cell sector but without producing interference. Practice has proved that when the downward angle of the electronically tunable antenna changes between 1°-5°, the directivity pattern of the electronically tunable antenna is roughly the same as that of mechanical antenna; when the downward angle changes between 5°-10°, the directivity pattern of the electronically tunable antenna is slightly improved from that of the mechanical antenna; when the downward angle changes between 10°-15°, the directivity pattern of the electronically tunable antenna is much different from that of the mechanical antenna; when the downward angle of the electronically tunable antenna exceeds 15°, the directivity pattern of the electronically tunable antenna is significantly different from that of the mechanical antenna, and in this case, the shape of the antenna pattern changes little, the coverage distance in the main lobe direction shortens significantly and entire antenna directivity pattern is within base station sectors. Thus, increasing the downward angle can shorten the coverage area of the sectors without producing interference. Such directivity pattern is what we need. Therefore, using electronically tunable antenna can decrease call loss and reduce interference. In addition, electronically tunable antenna allows system to adjust downtilt angle of the vertical directivity pattern and monitor adjustment effect in real time without the system going down. The stepping accuracy (0.1°) for adjusting the tilt angle is high, thereby fine adjustment for the network can be achieved.

The above characteristics of the electronically tunable antenna require that to achieve precise adjustment for the downtilt angle, idealized settings for mechanical tilt angle of antenna element must be guaranteed. Otherwise, idealized directivity pattern cannot be obtained by just adjusting the electrical downtilt angle. However, the changes of initial construction and mounting location of the station, which is caused by that the existing electronically tunable antenna encounters typhoon or mounting fixtures aging, cannot be found timely. When new base station sites are constructed, deviation occurs to the antenna mounting position. And adjustment for horizontal orientation and mechanical tilt angle cannot be controlled remotely. All these defects are due to that effective monitoring for horizontal orientation angle and mechanical tilt angle of the electronically tunable antenna cannot be made and working staff cannot obtain corresponding angle information timely, thereby resulting in the inconvenience for the construction and maintenance of electronically tunable antenna.

SUMMARY

The present disclosure provides an electronically tunable antenna based on orientation correction and adjustment and an electronically tunable antenna system, which can achieve precise adjustment for the corresponding angle of the electronically tunable antenna body by detecting physical orientation data of the electronically tunable antenna body.

The present disclosure provides an electronically tunable antenna based on orientation correction and adjustment, the main body of which includes at least one electronically tunable antenna body. The electronically tunable antenna includes:

an attitude sensing device fixed to the electronically tunable antenna body. The attitude sensing device senses horizontal orientation angle, mechanical tilt angle, latitude, longitude and height of the electronically tunable antenna body in real time; and an antenna control unit connected to the attitude sensing device. The antenna control unit adjusts electrical downtilt angle, horizontal orientation angle and mechanical tilt angle of the electronically tunable antenna body and transmits to outside the horizontal orientation angle, mechanical tilt angle, latitude, longitude and height information sensed by the attitude sensing device.

Therefore, by the attitude sensing device and the antenna control unit, the user can easily obtain current physical orientation information such as electrical downtilt angle, horizontal orientation angle, mechanical tilt angle, latitude, longitude and height etc. of the electronically tunable antenna body in real time, and conduct maintenance and debugging according to the angle information under ideal condition. Especially, the obtaining of mechanical tilt angle, horizontal orientation angle, height, latitude and longitude in real time provides reference for accurate installation of electronically tunable antenna.

Furthermore, in one embodiment, the electronically tunable antenna also includes a horizontal orientation angle and mechanical tilt angle control unit and a mechanical device for adjusting horizontal orientation angle and mechanical tilt angle of the electronically tunable antenna body. The mechanical device is provided with a drive motor and a transmission countershaft connected between an output shaft of the drive motor and a rotating shaft of the electronically tunable antenna body. The horizontal orientation angle and mechanical tilt angle control unit connects to and transmits angle control signal to the drive motor. In one embodiment, the drive motor includes a stepper motor or servo motor, the transmission countershaft includes gear group. Thus, by the horizontal orientation angle and mechanical tilt angle control unit and the mechanical device mounted at the lower end of the electronically tunable antenna body, precise adjustment for the horizontal orientation angle and mechanical tilt angle can be achieved.

Furthermore, in one embodiment, the attitude sensing device includes an electronic compass.

Furthermore, in one embodiment, the electronic compass has a three-axis magnetic sensor and a three-axis gravity acceleration sensor. Thus, by the three-axis magnetic sensor and the three-axis gravity acceleration sensor, full attitude monitoring for the electronically tunable antenna body can be achieved.

Furthermore, in one embodiment, the electronically tunable antenna has a remote control unit for adjusting electrical downtilt angle. The remote control unit includes a recording/reproducing storage device. Configuration data of the electronically tunable antenna is stored in the recording/reproducing storage device. The configuration data includes at least installation date, frequency band information and adjusting parameter of electrical tilt angel. Thus, by the recording/reproducing storage device, the user can easily inquire the configuration data corresponding to the electronically tunable antenna, thereby bringing convenience for adjusting and maintaining the electrical tilt angel etc.

The present disclosure provides another electronically tunable antenna based on orientation correction and adjustment, the main body of which includes at least one electronically tunable antenna body. The electronically tunable antenna includes:

an attitude sensing device fixed to the electronically tunable antenna body. The attitude sensing device senses horizontal orientation angle, mechanical tilt angle, latitude, longitude and height of the electronically tunable antenna body in real time;

a remote control unit for adjusting electrical downtilt angle. The remote control unit includes a recording/reproducing storage device. Configuration data of the electronically tunable antenna is stored in the recording/reproducing storage device. The configuration data includes at least installation date, frequency band information and adjusting parameter of electrical tilt angel; and a hand-held terminal connected to the attitude sensing device and the remote control unit. The hand-held terminal is used for adjusting electrical downtilt angle, horizontal orientation angle and mechanical tilt angle of the electronically tunable antenna, and is also used for setting parameters of the electronically tunable antenna.

Specifically, the hand-held terminal carries out power supply and communication through AISG cable. Thus, by the hand-held terminal, a portable, flexible and convenient way of control and adjustment for the electronically tunable antenna is achieved.

The present disclosure also provides an electronically tunable antenna system based on orientation correction and adjustment. The electronically tunable antenna system includes:

the above electronically tunable antenna; and at least one terminal control device. The terminal control device is connected to a first interface of the antenna control unit, and establishes communication link with the antenna control unit. Every terminal control device controls respectively at least one antenna control unit. The terminal control device includes display module for displaying antenna attitude information sensed by the attitude sensing device.

In one embodiment, the terminal control device includes PC or CCU.

Thus, by the terminal control device and its display module, effective remote monitoring for horizontal orientation angle, mechanical tilt angle, electrical downtilt angle, latitude, longitude and height of the electronically tunable antenna in real time is achieved, for example, displaying current information of the electronically tunable antenna in every base station in a form of electronic map, and then carrying out maintenance and adjustment as needed.

Furthermore, in one embodiment, the terminal control device also includes:

a storage module for storing angle range that corresponds to at least one of the preset horizontal orientation angle and mechanical tilt angle;

a comparing module connected to the storage module. The comparing module can generate alarm signal when comparing and determining that at least one of the horizontal orientation angle and the mechanical tilt angle sensed by the attitude sensing device exceeds the angle range; and an alarm module connected to the comparing module. The alarm module can alarm in a form of at least one of sound, light and short message service (SMS) according to the alarm signal.

Thus, by alarm function of the terminal control device, real time detecting and timely alarming for abnormal changes of the mechanical tilt angle and the horizontal orientation angle of the electronically tunable antenna can be achieved.

Furthermore, in one embodiment, the terminal control device also includes:

an input control module for generating, based on user input operation, an adjusting instruction corresponding to at least one of the horizontal orientation angle, the mechanical tilt angle and the electronically tunable angle of the electronically tunable antenna body. The antenna control unit controls electronically tunable antenna body to adjust the corresponding angle based on the adjusting instruction.

Thus, by the input control unit, remote control by users for the horizontal orientation angle, the mechanical tilt angle and the electronically tunable angle of the electronically tunable antenna can be achieved.

Furthermore, in one embodiment, the terminal control device is also provided with a map database for displaying physical location information of the base station to which the electronically tunable antenna belongs, an information database and an application database. The terminal control device communicates with the antenna control unit by SMS. Thus, by way of SMS communication, it can be achieved as long as there is a cell phone numbers. Compared with a way of using GPRS which requires station constructing and server address preparing, the present disclosure is simple and convenient, and its applicable range is wide.

The electronically tunable antenna based on orientation correction and adjustment and the system provided by the present disclosure, use a technical method of setting the attitude sensing device in the electronically tunable antenna body, thereby achieving the following effects: current physical orientation information, such as electrical downtilt angle, horizontal orientation angle, mechanical tilt angle, latitude, longitude and height, etc. of the electronically tunable antenna body can be obtained conveniently in real time; and maintenance and debugging according to the angle information under ideal conditions can be carried out.

DETAILED DESCRIPTION

It should be appreciated that embodiments and their features of the present disclosure can be combined with each other in case of no conflict. The followings are in detail to explain the present disclosure according to the drawings and the embodiments.

Figure 1:
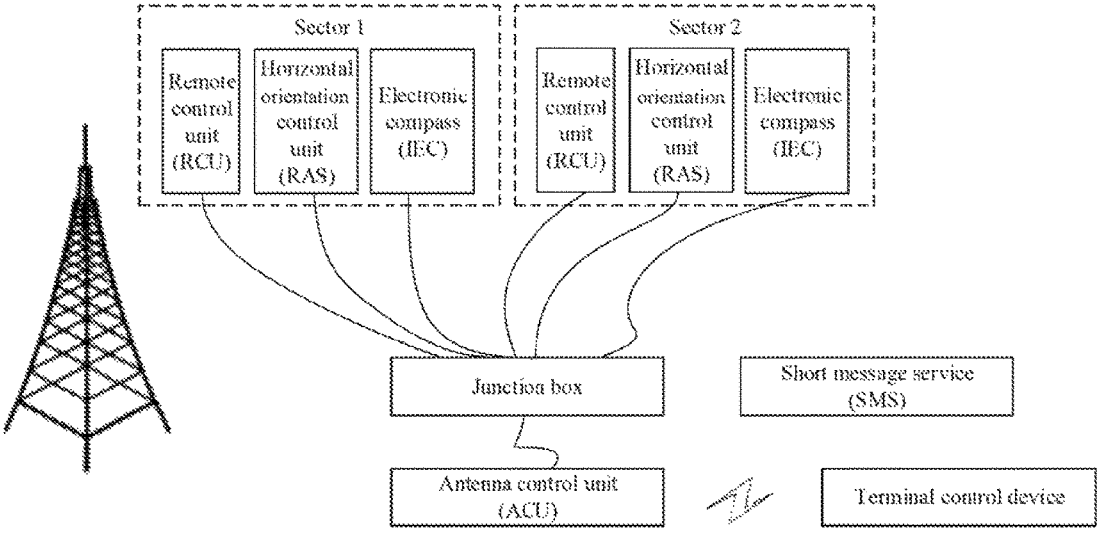
FIG. 1 is a structural view of the electronically tunable antenna system of the present disclosure.
Figure 2:
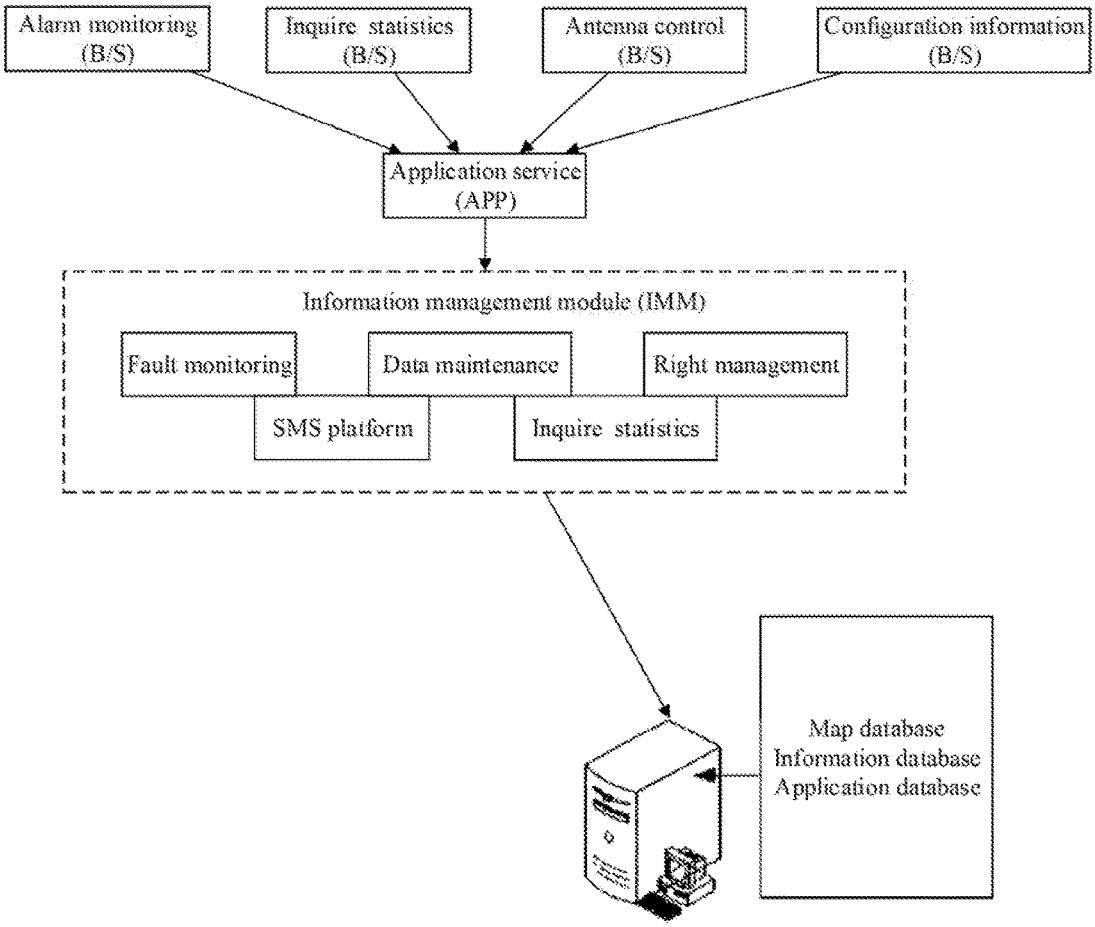
FIG. 2 is a function module view of the terminal control device of FIG. 1.

Please refer to FIG. 1 to FIG. 2, the present disclosure provides an electronically tunable antenna based on orientation correction and adjustment, the main body of which includes at least one electronically tunable antenna body. The electronically tunable antenna includes: an attitude sensing device, an antenna control unit, a horizontal orientation angle control unit and a mechanical device (not shown in the drawings).

The attitude sensing device is fixed to the electronically tunable antenna body, and is used for sensing the horizontal orientation angle, the mechanical tilt angle, latitude, longitude and height of the electronically tunable antenna body in real time. In one embodiment, the attitude sensing device includes an electronic compass. Furthermore, the electronic compass has a three-axis magnetic sensor and a three-axis gravity acceleration sensor.

The electronic compass used by the electronically tunable antenna of the present disclosure has the following features:

1. Supporting AISG2.0 communication protocols. Obtaining the electrical tilt angle, the horizontal orientation angle, the mechanical tilt angle, latitude, longitude and height of the electronically tunable antenna in real time via custom commands (such as via a predetermined time period).

2. By obtaining the horizontal orientation angle and the mechanical tilt angle in real time, position feedback can be provided to the horizontal orientation angle control unit for angle adjusting process, thereby forming a closed loop control system.

3. By obtaining the mechanical tilt angle, horizontal orientation angle, height, latitude and longitude in real time, installment references can be provided when constructing a new base station site.

4. Alarm function. Detecting the changes of the mechanical tilt angle or the horizontal orientation angle and alarming. On one hand, proactively alarm when the change on initial constructing and mounting location of the antenna (such as encountering a typhoon and the aging of the mounting and fixing parts) exceeds the predetermined range. proactively alarm when the antenna swings in a tower caused by wind exceeding the predetermined amplitude range.

The sensor of the electronic compass utilizes Honeywell's Anisotropic Magneto-Resistive (ARM) technology, with axial high sensitivity and linear high precision. The integrated circuit of the electronic compass includes an amplifier and an automatic degaussing drive. The integrated circuit can achieve offset calibration and make the compass heading accuracy to 1°~2°. General electronic compass has a relatively high requirement for horizontal level of the components under test. Once the electronic compass tilts a little, the reading errors would occur. The present disclosure can use high-precision electronic compass with tilt compensation function inside its sensor. The high-precision electronic compass is provided with a three-axis magnetic sensor and a three-axis gravity acceleration sensor, and is configured with built-in compensation algorithm, thereby can combine various sensor readings and provide stable readings. No matter how rugged the road is, the current orientation and tilt angle of the system can be provided stably. The present disclosure is particularly suitable for outdoor use or the occasion that needs stable readings. Therefore, the present disclosure can be used in the electronically tunable antenna for antenna positioning, and can be provided into AISG protocol. Supply voltage of the system is 2.0V~3.6V, which shows low-power consumption of the system.

The electronic compass is mainly used in the electronically tunable antenna for antenna positioning. The electronic compass is fixed to a certain fixed position in the electronically tunable antenna. Calibration is carried out after installation of the antenna. During the calibration, the compass and the platform for fixing the compass rotate 360 degree at a stable speed. This process lasts for 60 seconds to 3 minutes determined by end-user platform. The calibration program is to collect correction data of the geomagnetic field magnet distortion. This magnet effect is for magnetized materials nearby magneto resistive sensor portion. These materials are positioned in a fixed position in end-user platform. When exiting the calibration mode, calibrated offset and scale coefficient of the magnetometer have been updated so that users can get more accurate data. Current position offset information can be inquired through a handheld controller or Acslient software. Communication protocol is in compliance with AISG protocol. Such design has a simple hardware structure and good stability, eliminates the need for many peripheral circuits when using AD conversion, and avoids accuracy errors caused by the AD and the peripheral circuits.

The antenna control unit is connected to the attitude sensing device. The antenna control unit is used for adjusting the electrical downtilt angle, horizontal orientation angle and the mechanical tilt angle of the electronically tunable antenna and transmitting to outside the horizontal orientation angle, the mechanical tilt angle, latitude, longitude and height information sensed by the attitude sensing device.

The mechanical device is used for adjusting horizontal orientation angle and the mechanical tilt angle of the electronically tunable antenna body. The mechanical device is provided with a drive motor and a transmission countershaft connected between an output shaft of the drive motor and a rotating shaft of the electronically tunable antenna body. The horizontal orientation angle and the mechanical tilt angle control unit connects to and transmits angle control signal to the drive motor according to control instructions.

Preferably, the electronically tunable antenna also has a remote control unit for adjusting electrical downtilt angle. The remote control unit includes a recording/reproducing storage device. Configuration data of the electronically tunable antenna is stored in the recording/reproducing storage device. The configuration data includes at least installation date, frequency band information and adjusting parameter of electrical tilt angel.

In one embodiment, the present disclosure also provides another electronically tunable antenna based on orientation correction and adjustment, the main body of which includes at least one electronically tunable antenna body. The electronically tunable antenna includes an attitude sensing device, a remote control unit and a hand-held terminal. That is, what is different from the above embodiment is that, the antenna control unit is replaced by the hand-held terminal which is portable and can conduct control easily.

The attitude sensing device is fixed to the electronically tunable antenna body and is used for sensing horizontal orientation angle, mechanical tilt angle, latitude, longitude and height of the electronically tunable antenna body in real time.

The remote control unit is used for adjusting electrical downtilt angle. The remote control unit includes a recording/reproducing storage device. Configuration data of the electronically tunable antenna is stored in the recording/reproducing storage device. The configuration data includes at least installation date, frequency band information and adjusting parameter of electrical tilt angel.

The hand-held terminal is connected to the attitude sensing device and the remote control unit. The hand-held terminal is used for adjusting electrical downtilt angle, horizontal orientation angle and mechanical tilt angle of the electronically tunable antenna, and is also used for setting parameters of the electronically tunable antenna.

The present disclosure also provides an electronically tunable antenna system based on orientation correction and adjustment. The electronically tunable antenna system includes the above described electronically tunable antenna and further includes a terminal control device. The terminal control device is connected to a first interface of the antenna control unit, and establishes communication link with the antenna control unit. Every terminal control device controls respectively at least one antenna control unit. The terminal control device includes a display module for displaying antenna attitude information sensed by the attitude sensing device.

In one embodiment, the terminal control device also includes a storage module, a comparing module and an alarm module.

The storage module stores angle range corresponding to at least one of the preset horizontal orientation angle and mechanical tilt angle.

The comparing module is connected to the storage module. The comparing module is used for generating alarm signal, when it compares and determines that at least one of the horizontal orientation angle and the mechanical tilt angle sensed by the attitude sensing device exceeds the angle range.

The alarm module is connected to the comparing module and alarm in the form of at least one of sound, light and SMS according to the alarm signal.

In one embodiment, the terminal control device also includes an input control module. The input control module is used for generating, based on user input operation, an adjusting instruction corresponding to at least one of the horizontal orientation angle, the mechanical tilt angle and the electronically tunable angle of the electronically tunable antenna body. The antenna control unit controls, based on the adjusting instruction, the electronically tunable antenna body to adjust angle accordingly.

In one embodiment, the terminal control device is also provided with a map database for displaying physical location information of the base station which the electronically tunable antenna belongs to, an information database and an application database. The terminal control device communicates with the antenna control unit by SMS. These databases are used for providing data support, such as alarm monitoring, information statistics and configuration information, for the system.

Above all, the electronically tunable antenna system of the present disclosure collects and manages information (such as latitude, longitude and height, electrical downtilt angle, mechanical tilt angle and horizontal orientation angle) of the base station antenna. Remote control for antenna adjustment (such as electrical downtilt angle, horizontal orientation angle and mechanical tilt angle) is the core function. The centralized antenna information intelligent management platform based on Web electronic map, facilitates network optimization and maintenance.

The electronically tunable antenna system includes two sub-systems of management and control of antenna information. Wherein interactive interface is GSM message that is sent between the terminal control device in a remote centralized-control computer room and the antenna control unit of local site. The terminal control device is final user oriented and uses B/S structure design.

Figure 3:
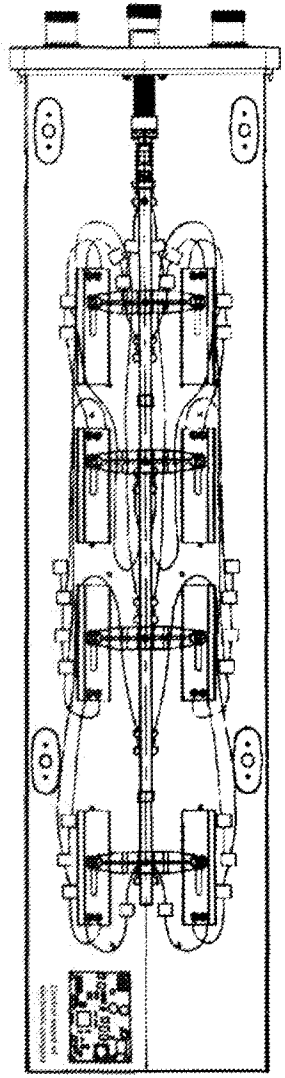
FIG. 3 is a structural view of the present disclosure when a control board of the electronic compass being in a first position.
Figure 4:
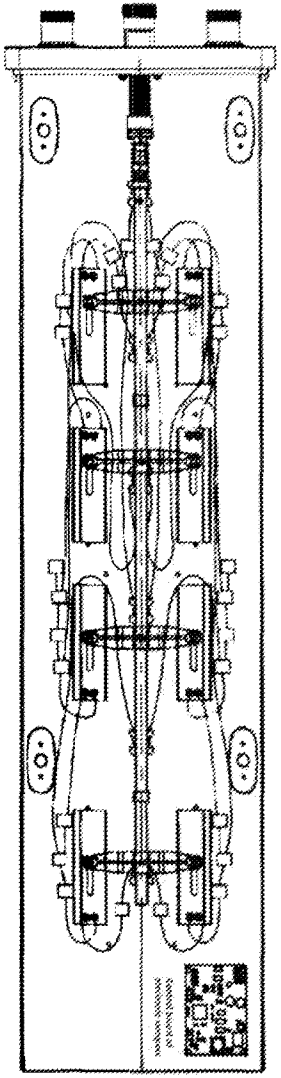
FIG. 4 is a structural view of the present disclosure when a control board of the electronic compass being in a second position.

Please refer to FIG. 3 and FIG. 4. If the corresponding electronic compass control board is mounted in the top right position of the electronically tunable antenna body as shown in FIG. 3, when testing, the electronic compass has the highest accuracy and basically has no errors. If the corresponding electronic compass control board is mounted in the top left position of the electronically tunable antenna body as shown in FIG. 4, when testing, the electronic compass has an error angle of 1-2°. If the corresponding electronic compass control board is mounted in other positions, the controller of the electronic compass has worse measurement accuracy.

Although embodiments of the present invention have been shown and described, for a person skilled in the art, it should be understood that various changes, modifications, substitutions and deformations, may be made to these embodiments without departing from the principle and spirit of the present invention. The scope of the present invention is defined by the claims and the equivalent scope of the claims.

What claimed is:

1. An electronically tunable antenna based on orientation correction and adjustment, the main body of which comprises at least one electronically tunable antenna body, the electronically tunable antenna comprising:

an attitude sensing device fixed to the electronically tunable antenna body, the attitude sensing device being configured with built-in tilt compensation function to provide stabilized readings, the attitude sensing device being configured to sense horizontal orientation angle, mechanical tilt angle, latitude, longitude, and height in real time with respect to the electronically tunable antenna body; and an antenna control unit connected to the attitude sensing device, the antenna control unit being configured to adjust an electrical downtilt angle of the electronically tunable antenna body by changing a phase of an antenna element of the electronically tunable antenna based on the horizontal orientation angle, mechanical tilt angle, latitude, longitude, and height sensed by the attitude sensing device, and to transmit to outside the horizontal orientation angle, mechanical tilt angle, latitude, longitude, and height information sensed by the attitude sensing device.

2. The electrically tunable antenna based on orientation correction and adjustment of claim 1, further comprising:

a horizontal orientation angle and mechanical tilt angle control unit; and a mechanical device for adjusting horizontal orientation angle and mechanical tilt angle of the electronically tunable antenna body, wherein the mechanical device includes a drive motor and a transmission countershaft connected between an output shaft of the drive motor and a rotating shaft of the electronically tunable antenna body, and the horizontal orientation angle and mechanical tilt angle control unit is connected to the drive motor and transmits an angle control signal to the drive motor.

3. The electronically tunable antenna based on orientation correction and adjustment of claim 1, wherein the attitude sensing device comprises an electronic compass, and the electronically tunable antenna further comprises an electronic compass control board in the top right portion of the electronically tunable antenna body.

4. The electronically tunable antenna based on orientation correction and adjustment of claim 3, wherein:

the electronic compass includes a three-axis magnetic sensor and a three-axis gravity acceleration sensor.

5. The electronically tunable antenna based on orientation correction and adjustment of claim 1, wherein:

the electronically tunable antenna has a remote control unit for adjusting the electrical downtilt angle, the remote control unit comprises a recording/reproducing storage device, configuration data of the electronically tunable antenna is stored in the recording/reproducing storage device, and the configuration data comprises at least installation date, frequency band information and adjusting a parameter of the electrical tilt angle.

6. An electronically tunable antenna system comprising the electronically tunable antenna of claim 1, the electronically tunable antenna system further comprising:

at least one terminal control device, the terminal control device is connected to a first interface of the antenna control unit, and establishes communication link with the antenna control unit, every terminal control device controls respectively at least one antenna control unit, the terminal control device comprises a display module that displays antenna attitude information sensed by the attitude sensing device.

7. The electronically tunable antenna system of claim 6, wherein the terminal control device further comprises:

a storage module for storing an angle range that corresponds to at least one of the preset horizontal orientation angle and mechanical tilt angle;

a comparing module connected to the storage module, the comparing module generates alarm signal when it compares and determines that at least one of the horizontal orientation angle and the mechanical tilt angle sensed by the attitude sensing device exceeds the angle range; and an alarm module connected to the comparing module, the alarm module alarms according to the alarm signal in the form of at least one of sound, light and SMS.

8. The electronically tunable antenna system of claim 6, wherein the terminal control device further comprises an input control module for generating, based on user input operation, an adjusting instruction corresponding to at least one of the horizontal orientation angle, the mechanical tilt angle and the electronically tunable angle of the electronically tunable antenna body, and the antenna control unit controls the electronically tunable antenna body to adjust corresponding angle based on the adjusting instruction.

9. The electronically tunable antenna system of claim 6, wherein the terminal control device further comprises:

a map database for displaying physical location information of the base station that the electronically tunable antenna belongs to;

an information database; and an application database, wherein the terminal control device communicates with the antenna control unit by SMS.

10. An electronically tunable antenna based on orientation correction and adjustment, the main body of which comprises at least one electronically tunable antenna body, the electronically tunable antenna comprising:

an attitude sensing device fixed to the electronically tunable antenna body, the attitude sensing device being configured with built-in tilt compensation function to provide stabilized readings, the attitude sensing device senses horizontal orientation angle, mechanical tilt angle, latitude, longitude, and height in real time with respect to the electronically tunable antenna body;

a remote control unit for adjusting electrical downtilt angle of the electronically tunable antenna body by changing a phase of an antenna element of the electronically tunable antenna based on the horizontal orientation angle, mechanical tilt angle, latitude, longitude and height sensed by the attitude sensing device and transmitted to outside by an antenna control unit, wherein the remote control unit comprises a recording/reproducing storage device, configuration data of the electronically tunable antenna is stored in the recording/reproducing storage device, and the configuration data comprises at least installation date, frequency band information, and adjusting parameter of electrical tilt angle; and a hand-held terminal connected to the attitude sensing device and the remote control unit, the hand-held terminal being configured to be used for adjusting electrical downtilt angle, horizontal orientation angle, and mechanical tilt angle of the electronically tunable antenna, and being also used for setting parameters of the electronically tunable antenna.

11. An electronically tunable antenna system comprising the electronically tunable antenna of claim 10, the electronically tunable antenna system further comprising:

at least one terminal control device, the terminal control device is connected to a first interface of the antenna control unit, and establishes communication link with the antenna control unit, every terminal control device controls respectively at least one antenna control unit, the terminal control device comprises a display module that displays antenna attitude information sensed by the attitude sensing device.

12. The electronically tunable antenna system of claim 11, wherein the terminal control device further comprises:

a storage module for storing an angle range that corresponds to at least one of the preset horizontal orientation angle and mechanical tilt angle;

a comparing module connected to the storage module, the comparing module generates alarm signal when it compares and determines that at least one of the horizontal orientation angle and the mechanical tilt angle sensed by the attitude sensing device exceeds the angle range; and an alarm module connected to the comparing module, the alarm module alarms according to the alarm signal in the form of at least one of sound, light and SMS.

13. The electronically tunable antenna system of claim 11, wherein the terminal control device further comprises an input control module for generating, based on user input operation, an adjusting instruction corresponding to at least one of the horizontal orientation angle, the mechanical tilt angle and the electronically tunable angle of the electronically tunable antenna body, and the antenna control unit controls electronically tunable antenna body to adjust corresponding angle based on the adjusting instruction.

14. The electronically tunable antenna system of claim 11, wherein the terminal control device further comprises:

a map database for displaying physical location information of the base station that the electronically tunable antenna belongs to;

an information database; and an application database, wherein the terminal control device communicates with the antenna control unit by SMS.

* * * * *